US007073694B2

(12) United States Patent
King et al.

(10) Patent No.: US 7,073,694 B2
(45) Date of Patent: Jul. 11, 2006

(54) HYBRID CONSTRUCTION FOR A LUGGAGE CASE

(75) Inventors: William L. King, Denver, CO (US); Edward F. Wholley, Raynham, MA (US)

(73) Assignee: Samsonite Corporation, Denver, CO (US)

( * ) Notice: Subject to any disclaimer, the term of this patent is extended or adjusted under 35 U.S.C. 154(b) by 28 days.

(21) Appl. No.: 10/399,059

(22) PCT Filed: Oct. 10, 2001

(86) PCT No.: PCT/US01/31974

§ 371 (c)(1),
(2), (4) Date: Jan. 15, 2004

(87) PCT Pub. No.: WO02/30234

PCT Pub. Date: Apr. 18, 2002

(65) Prior Publication Data

US 2004/0129748 A1 Jul. 8, 2004

Related U.S. Application Data

(60) Provisional application No. 60/239,862, filed on Oct. 11, 2000.

(51) Int. Cl.
*A45C 15/00* (2006.01)

(52) U.S. Cl. ..... 224/576; 590/18 R

(58) Field of Classification Search ..... 224/576, 224/627, 628, 629, 639, 265, 266, 166, 642, 224/643; 190/125, 39, 18 R, 122–127; 150/107, 150/109

See application file for complete search history.

(56) References Cited

U.S. PATENT DOCUMENTS

| | | | | |
|---|---|---|---|---|
| 5,431,317 | A * | 7/1995 | Kliot | 224/153 |
| 5,639,004 | A * | 6/1997 | Carlton et al. | 224/579 |
| 6,138,881 | A * | 10/2000 | Paul et al. | 224/153 |
| 6,382,489 | B1 * | 5/2002 | Chuang | 224/637 |

* cited by examiner

*Primary Examiner*—Lien M. Ngo
(74) *Attorney, Agent, or Firm*—Gregory W. O'Connor

(57) ABSTRACT

A luggage case (10) has a molded, relatively hard or rigid back portion affixed to the relatively soft fabric constructed front portion (12). A connector form (25) constructed of an extruded, flexible shape extends around the peripheral rim (19) of the back portion, and has a first free end (30) which is attached by sewing to a gusset (21) that extends around the front portion (11). The connector form (25) has an upper portion that has one and preferably two channels on an outer portion, one of which contains a stiffening wire (36). The upper portion is fastened by stitching to the rim (19) of the back portion. The upper portion includes at least a pair of protruding pockets (22), which define a gap or channel (23) there between. A strap (39) attached to opposite sides of the back portion by triangular-shaped anchors, passes through this gap or channel (23) and had a lifting handle (38) attached thereto. A shoulder harness has ends that can be attached to an end of the back portion and to the lifting handle (38) at a shoulder yolk can be used to carry the luggage case (10) on one's back.

4 Claims, 9 Drawing Sheets

HYBRID CONSTRUCTION FOR A LUGGAGE CASE

This application is a 371 of PCT/US 01/3194 filed on Oct. 10, 2001, which claims benefit of 60/239,862 filed on Oct. 11, 2000.

TECHNICAL FIELD

This invention relates to constructing luggage cases from various materials, and in particular luggage constructions that use molded plastic parts and fabric parts. More particularly, such luggage cases are assembled using industrial sewing operations. Where a major portion of the outside envelope of the luggage case has large molded portions and large fabric portions, this type of luggage construction is generally called hybrid, referring to the fact that the molded portion is generally made like hard shelled luggage cases, but he the fabric portion has many esthetic and technical similarities to so-called soft side luggage cases.

BACKGROUND ART

Generally, hybrid luggage cases conceptually are similar to a type of molded bottom wheeled duffle bag popular in the 1960's and 1970's. U.S. Pat. No. 5,588,569 shows this type of construction applied to the now popular upright case. Later, Samsonite Corporation popularized a line of luggage that incorporated hybrid construction techniques. This luggage case is shown in U.S. Pat. No. D427,434.

DISCLOSURE OF INVENTION

DETAILED DESCRIPTION OF THE PREFERRED EMBODIMENT

Best Mode for Carrying out the Invention

Figure 1:
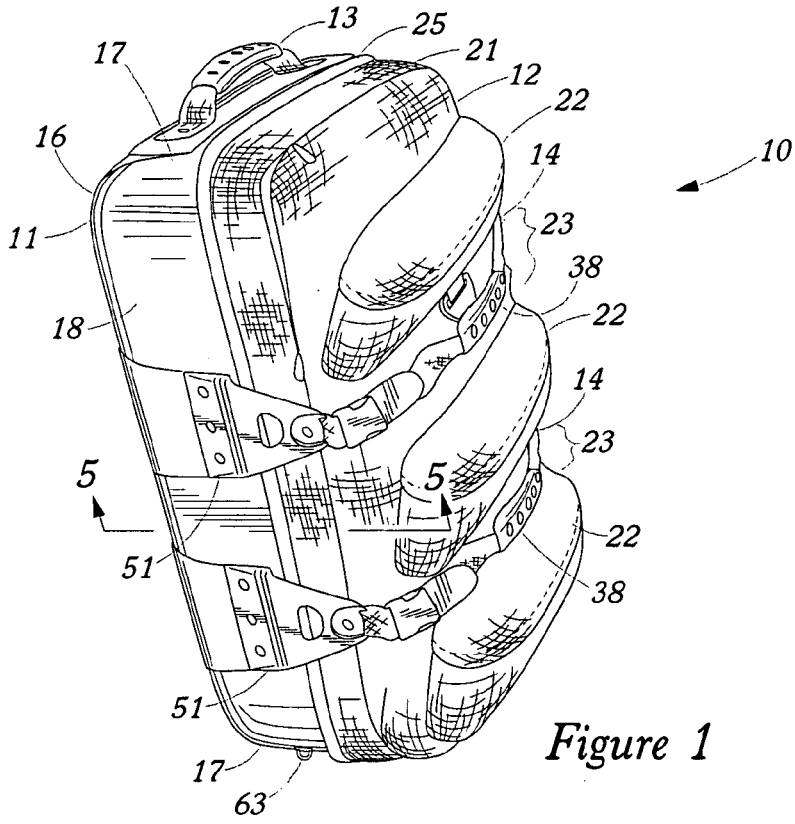
FIG. 1 is a front isometric view of one embodiment of the luggage case fully packed.

A luggage case incorporating the features of the present invention is shown in FIG. 1. The luggage case 10 includes a rear portion 11 that is vacuum formed from a sheet of flexible thermoplastic, similar to that used in a typical hard luggage shell construction, a front portion 12 attached to the rear portion 11, the front portion 12 being made of a soft-sided luggage construction of fabric shapes and panels, a carry handle 13 attached at a central location along one of the sides of the luggage case 10, two strap systems 14 used to compress and stabilize the load inside the case, and an optional back pack carry strap 15 (see FIGS. 11–14). The rear shell portion of the luggage case 10 has a rear-facing surface 16, opposing top and bottom surfaces 17, and opposing side surfaces 18. The edge of the opposing side surfaces and the opposing top and bottom surfaces forms a perimeter rim 19 to which is attached the front portion 12 of the luggage case 10. The rear portion 11 of the luggage case 10 can include an extendable handle 20, which fits in a collapsed position in the back surface of the luggage case 10, and extends from that collapsed position to an extended position as desired by the user. In conjunction with the extendable handle 20, at least a pair of wheels (not shown) can be attached to the rear portion 11 adjacent the intersection of the back surface with the bottom surface as is conventional for this upright style of luggage case for convenience in moving the luggage case 10 along a support surface.

Figure 2:
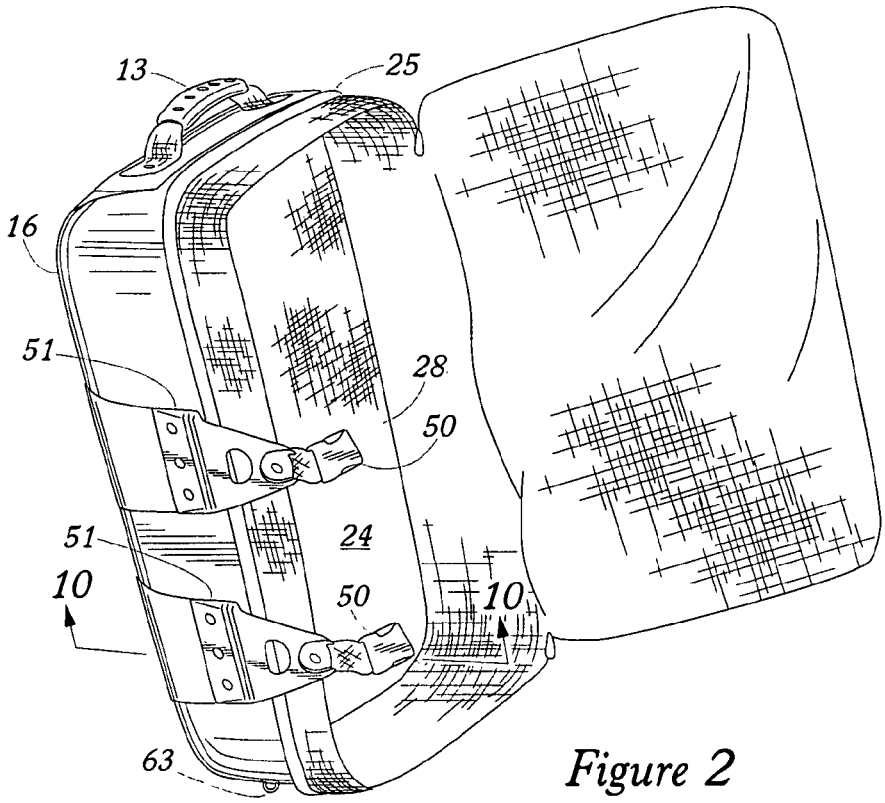
FIG. 2 is a front isometric view of one embodiment of the luggage case empty with the top surface unzipped.
Figure 3:
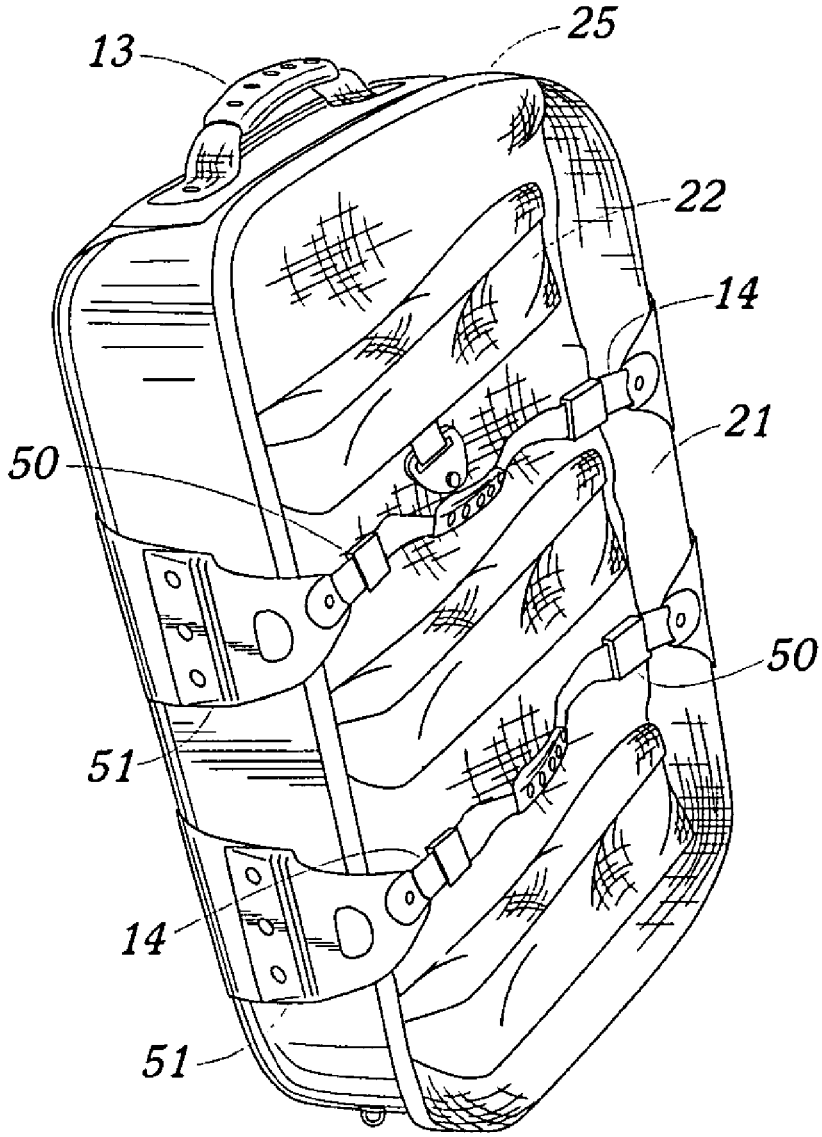
FIG. 3 is a front isometric view of one embodiment of the luggage case empty and closed.

Referring still to FIG. 1, and to FIGS. 2 and 3, the front portion 12 of the luggage case 10 includes a gusset or collar 21 forming a rim around and extending rearwardly from the front surface of the luggage case 10. The front surface of the front portion 12 of the luggage case 10 includes a variety of pockets, and as disclosed herein, includes a series of three pockets 22 extending horizontally and spaced vertically from one another on the front surface of the front portion 12 of the luggage case 10. The three front pockets 22 form two channels 23 there between for receiving the strap systems 14, which are described in greater detail below. The gusset 21 attached to the front surface of the front portion 12 of the luggage case 10 defines a perimeter which is attached to the perimeter rim 19 of the rear portion 11 of the luggage case 10. The perimeter of the gusset 21 is attached to the perimeter rim 19 of the rear portion 11 of the luggage case 10 by a connector form designed specifically to integrate and connect these two pieces together in a strong, convenient and durable manner.

The rear and front portion 12s, when attached together, define an inner cavity 24 for receiving articles for packing. The volume of the luggage case 10 in the rear portion 11 is relatively fixed due to the formed hard-sided structure, while the volume of the front portion 12 is variable given its soft-sided construction. The strap system 14 assists in stabilizing the load when the luggage case 10 is not filled to capacity, as is described in greater detail below. The gusset 21 allows the luggage case 10 to expand or contract, by the front surface moving toward or away from the rear portion 11, depending on the desired load. The attachment of the gusset 21 to the rear portion 11 of the luggage case 10 facilitates either large or small loads easily, and in further combination with the support strap system 14 facilitates in securing any variety of sizes of loads in the luggage case 10.

Figure 4:
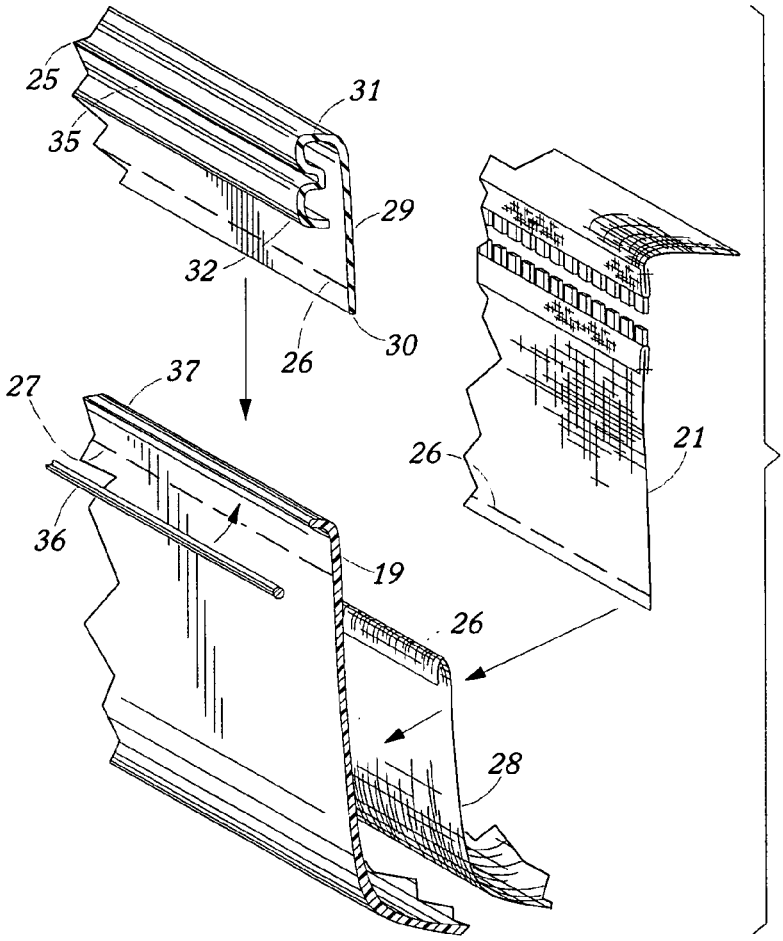
FIG. 4 is a close-up exploded view of the connection form and the top and rear portion 11 s of one embodiment of the luggage case joined by the form.
Figure 5:
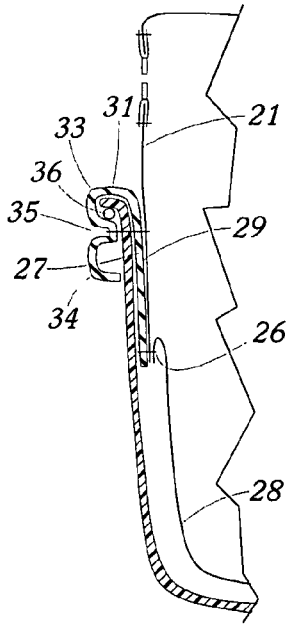
FIG. 5 is a section view taken along line 5—5 of FIG. 1 illustrating the connection form, top portion, and rear portion 11 of one embodiment of the luggage case in a joined position.

The connector form 25 for attaching the rear portion 11 to the front portion 12 of the luggage case 10 is shown in FIGS. 4 and 5. The preferably flexible connector form 25 is made of plastic or rubber and is formed by an extrusion process for continuous application around the entire perimeter rim 19 of the hard shell as well as the entire perimeter of the soft-sided gusset 21. The connector form 25 attaches to the front portion 12 preferably by a sewing stitch 26, which connects the form, the gusset 21, and a liner 28 together. The connector form 25 also attaches to the rear portion 11 and gusset 21 preferably by a sewing stitch 27.

The cross-sectional shape of the connector form 25 is best shown in FIGS. 4 and 5, and includes a generally straight, downwardly depending (as oriented in FIGS. 4 and 5) inner wall 29. The bottom end of the inner wall 29 is a free end 30 and the top end of the inner wall 29 is attached integrally to the top wall 31 of the connector form 25. An outer wall 32 of the connector form 25 attaches integrally at its top end with the top wall 31 of the connector form 25. The outer wall 32 includes two distinct inwardly directed channels: a top channel 33 and a bottom channel 34. The two channels are separated by an indentation forming an outwardly directed slot 35. The outer wall 32 of the connector form 25 thus generally has a W-shape in cross-section. The outer wall 32 does not extend as far downwardly as the inner wall 29, which allows the inner wall 29, to which the liner 28 and gusset 21 are attached by stitch 26, to permit free access to properly place the stitch 27 around the perimeter of the rear portion 11.

An interior space is formed in the connector form 25 by the combination of the inner, top and outer walls, and is continuous along the length of the connector form 25. As mentioned above, the connector form 25 facilitates the attachment of the front portion 12 to the rear portion 11 of the luggage case 10. This is again best shown in FIGS. 4 and 5. Referring still to FIG. 4, a portion of the gusset 21, zipper, top surface of the soft-sided portion of the luggage case 10, the liner 28 for the rear portion 11 of the luggage case 10, the sidewall defining the rim 19 of the rear portion 11 of the luggage case 10, as well as a stiffening member, such as a tempered steel wire 36, that assists in holding the shape of the rear portion 11 and for strengthening the interface of all these pieces, are shown in an exploded view. Note that the perimeter rim 19 of the rear portion 11 of the luggage case 10 has an outwardly flaring flange 37 around substantially the entire length of the perimeter rim 19. Preferably, this flange 37 is formed by trimming off the excess thermoplastic material after vacuum forming the back portion.

When attached together, as shown in FIG. 5, the bottom portion of the gusset 21 and the top portion of the liner 28 are attached to the bottom free end 30 of the inner wall 29 of the connector form 25. The sewing attachment 26 is performed before the connector form 25 is placed on the perimeter rim of the hard-sided rear portion 11. Once the gusset 21 and the liner 28 are attached to the bottom end of the inner wall 29, the connector form 25 is then positioned on the rim of the of the luggage case 10. In doing this, the perimeter rim 19 of the rear portion 11 is received in the recess such that the outward flange 37 at the top of the rim 19 of the rear portion 11 is received in the top channel 33. The inside surface of the inner wall 29 of the connector form 25 engages the inside surface of the rim 19, with the flange 37 in the inside surface of the rim 19 in relatively continuous contact with the inside surface of the inner wall 29, as shown in FIG. 5.

The stiffening member is positioned under the flange 37 of the perimeter rim and extends continuously around the rim 19. The stiffening member is positioned in the top recess channel when the connector form 25 is placed on the rim 19 of the rear portion 11. The wire 36 helps stiffen the rim 19 structure for stability and durability during use. The connector form 25 is then attached to the hard-sided luggage portion and the gusset 21 by placing a sewing stitch line 27 continuously around the rim 19 of the hard-sided portion in the indentation 35 formed on the outer wall 32 of the connector form 25. The sewing extends through the outer wall 32 of the connector form 25, through the wall of the rear portion 11, and finally through the inside wall of the connector form 25. Optionally for firmer attachment, this sewing stitch could also pass through and thus attach the gusset 21 as well. Preferably however, the fabric portions of the front portion 12 are stuffed into the cavity 24 of the bottom portion during this final sewing operation, well out of the way of the sewing machine arm and guide dogs used to place the stitch line 27. This permits the sewing machine operator to concentrate on manipulating the cumbersome luggage case 10, repositioning it to feed the assembled connector form 25, stiffening member, and the front and back portions during sewing. The lower channel of the outer wall 32 of the connector form 25 is not further attached to the hard-sided rear portion 11.

The use of the connector form 25 to attach the soft-sided front portion 12 to the hard-sided rear portion 11 allows for a simple yet strong attachment structure. By not attaching the lower free end 30 of the inner wall 29 of the connector form 25 to the rear portion 11, the liner and the lower portion of the inside wall can flex away from the hard-sided portion as needed, which alleviates stress on that connection point. Attaching the connector form 25 to the hard-sided portion through all four layers as described above at a location between the top and bottom channels securely positions the top rim 19 of the hard-sided portion securely in the top channel 33, as well as keeps the wire 36 stabilizing member in proper position.

Figure 6:
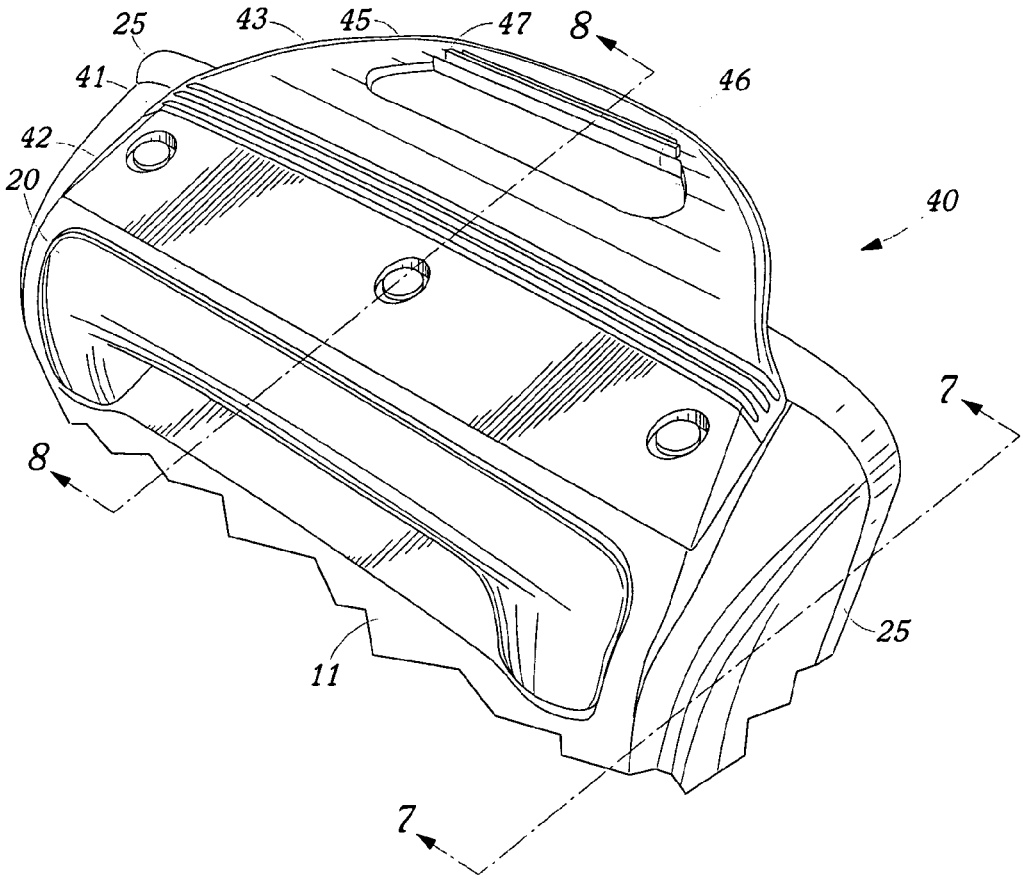
FIG. 6 is a top isometric view of one embodiment of the flap handle.
Figure 7:
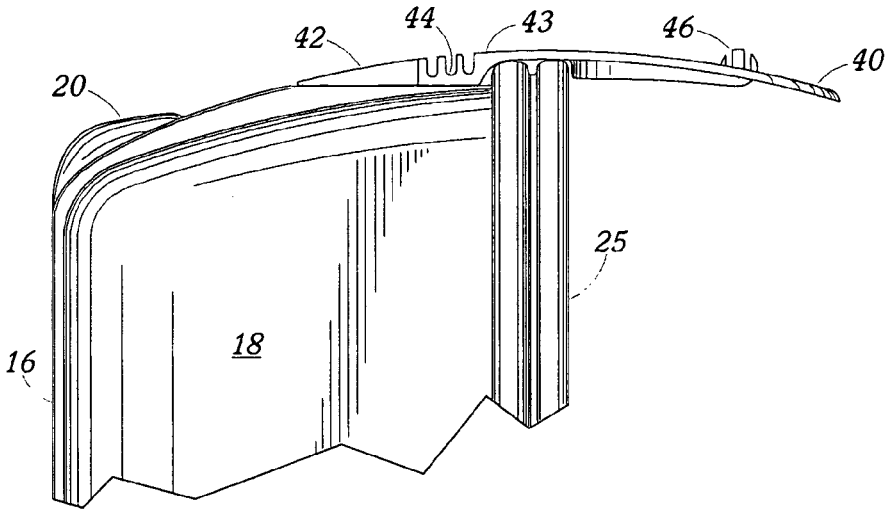
FIG. 7 is a profile view taken along line 7—7 of FIG. 6 illustrating the low profile of one embodiment the flap handle.
Figure 8:
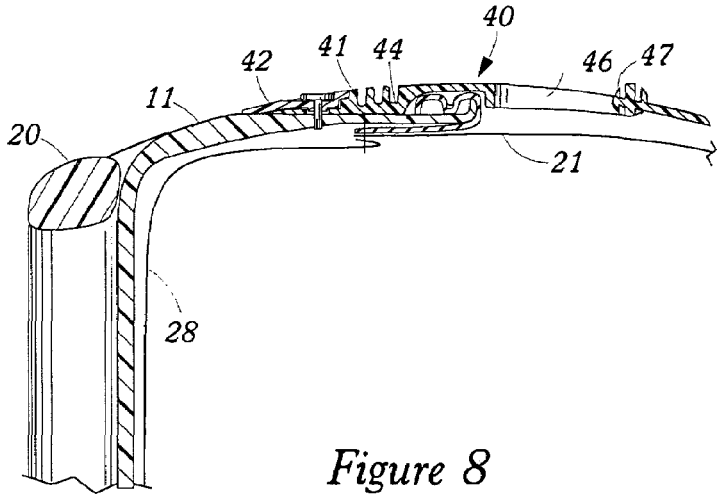
FIG. 8 is a section view taken along line 8—8 of FIG. 6 illustrating both the low profile and the preferred connection means of one embodiment of the flap handle.

As mentioned above and shown in FIGS. 1–3, in a preferred embodiment of the present invention, a carry handle 13 is attached at a central location along one of the sides 17 or 18 of the luggage case 10. In an alternative embodiment of the present invention, a low-profile flap handle 40 replaces the carry handle 13 illustrated in FIGS. 1–3. As shown in FIGS. 6–8, the flap handle 40 is generally attached in approximately the same location as the preferred embodiment carry handle 13. The flap handle 40 serves the same function as the carry handle with the additional feature of being low-profile with respect to the side surface of the luggage case 10 (see FIG. 7).

As shown in FIGS. 6–8, at one end of the flap handle 40 is a base portion 41 having connection apertures through which connection rivets are inserted to attach the flap handle 40 to the side of the luggage case 10. The base portion 41 can run substantially along the width of the luggage case 10, if shorter, can be centrally located. A matching base cap 42 that also includes connection apertures covers the base portion 41. A central portion 43 is formed adjacent the base portion 41 and includes at least one groove 44 running across the width of the flap handle 40. The groove 44 serves to form an integral hinge portion. A semi-circular carry handle portion 45 is formed adjacent the central portion. The carry handle portion 45 includes a central handle aperture 46 bordered along the top by a ribbed handle portion 47. Preferably, the handle aperture 46 is sized to allow a typical user to grasp the flap handle 40. In addition, the ribbed handle portion is configured to increase the comfort and grip of the user. The ribbed handle portion 47 also serves to give the user a portion of the handle to grasp when pulling the handle upward away from the side surface 17 of the luggage case 10.

In a preferred embodiment, the flap handle 40 is made of a resilient, substantially flexible material. Preferably, the flexible nature of the material in conjunction with the groove or grooves will provide an integral hinged portion that allows the carry handle portion of the flap handle 40 to be pulled upward, away from the side surface of the luggage case 10 to act as a carry handle for the luggage case 10.

As mentioned above and illustrated in FIG. 7, when the flap handle 40 is not being used, it lays substantially flat along the surface of the luggage case 10 thereby creating a low-profile handle with respect to the surface of the luggage case 10.

In FIG. 8 is a section view illustrating the low profile of the flap handle 40 and a preferred means of connecting the flap handle 40 to the side 17 of the luggage case 10. The flap handle 40 is connected to the side of the luggage case 10 via fasteners, such as rivets, that are inserted through the connection apertures in the flap handle 40 and through the molded shell of the luggage case 10.

As mentioned above and illustrated in FIGS. 1–3, the luggage case 10 includes two strap systems in the channels 23 formed between the pockets 22 on the front portion 12 of the luggage case 10. Each carry strap system 14 includes a central carry handle 38, an adjustable strap 39 running through and extending from both sides of the carry handle 38, a connection clasp 50 including male portions attached to both ends of the adjustable strap 39, and female portions pivotally attached to the ends of generally triangularly shaped wrap-around strap anchors 51. The adjustable strap 39 is attached to the front surface of the front portion 12 by rivets, sewing or other means.

As mentioned above, the strap system 14 assists in stabilizing the load, when the luggage case 10 is not filled to capacity. The user may either increase or decrease the length of the strap depending on the size of the load. When the luggage case 10 is not filled to capacity, the user will want to decrease the length of the strap thereby compacting the soft side front portion 12 into the hard side rear portion 11 of the luggage case 10. In the opposite case, the user will want to increase the length of the strap to allow the soft side top portion of the luggage case 10 to expand thereby creating more volume to accommodate a larger load.

The support strap system strap anchors 51 are configured to extend from the molded rear portion 11 and wrap around a portion of the soft side front portion 12. By wrapping around or partially over the soft side front portion 12 of the luggage case 10, the strap anchors 51 serve to support and protect the soft side portion of the luggage case 10 and protect the luggage case 10 from side impact forces.

Figure 9:
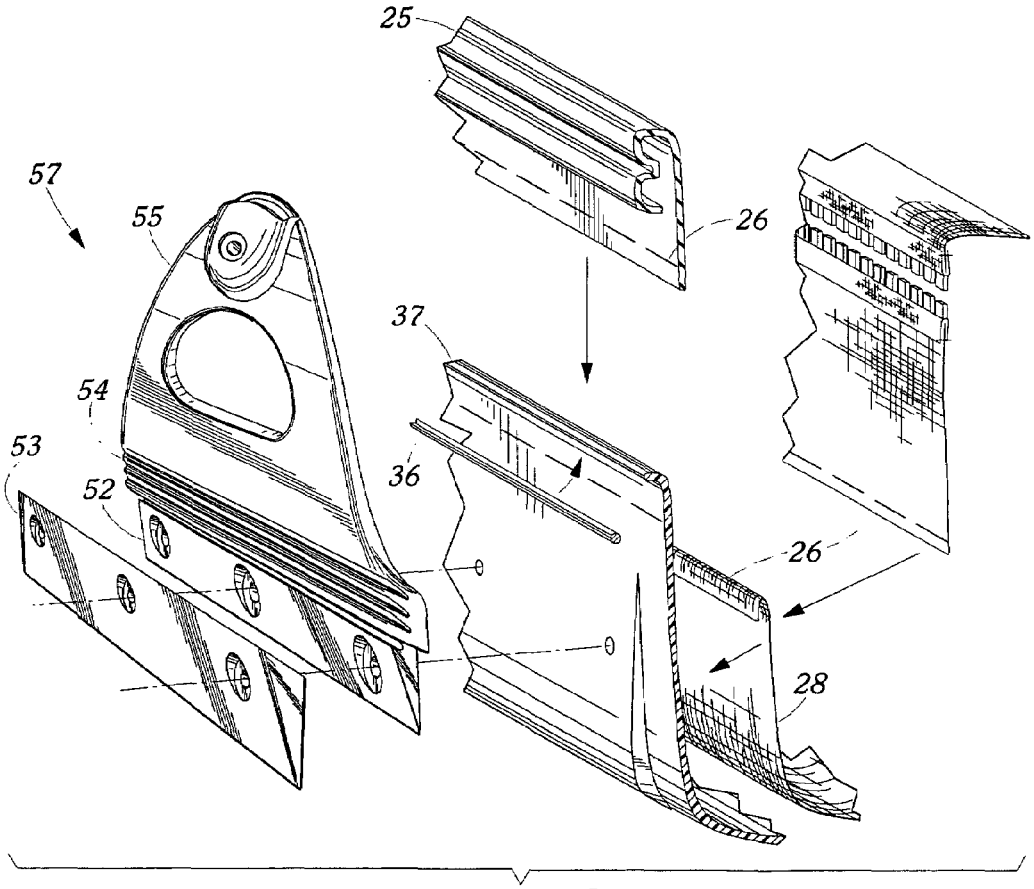
FIG. 9 is a close-up exploded view of the strap anchor 51 and the portions of one embodiment of the luggage case to which it attaches.

As illustrated in FIG. 9, each strap anchor 51 includes two pieces: a first piece having a base portion 52, an intermediate hinged portion 54, and a generally triangular, apertured top portion 55; and a second bottom face plate piece 53 that covers the base portion 52. Both the bottom face plate and the base portion 52 include aligned connection apertures for receiving a rivet or screw. Both the bottom face plate 53 and the base portion 52 are generally rectangular and are substantially similar in shape. Both the bottom face plate 53 and the base portion 52 have generally wedge-shaped cross-sections to minimize the overall profile of the strap anchor 51 when connected to the luggage case 10, and to enhance its strength. A space (FIG. 10) formed between the apertured top portion 55 and the intermediate hinged portion 54 on the inner surface of the strap anchors 51 receives the connector form 25 and allows the anchor to lie flush on the luggage case 10.

The integral hinged portion located intermediate to the strap anchor 51 increases the flexibility of the strap anchor 51 thereby allowing the support strap system 14 to give-and-take with the shifting of loads. The pivot point attachment portion at the top of the strap anchor 51 provides additional flexibility. One end of the female connection clasp 50 is pivotally connected via a small length of webbing to the pivot point attachment portion thereby providing the female connection and thus the entire support strap system 14 additional flexibility. It is contemplated that the attachment mechanisms on the end of the straps could be reversed, or could be some other mechanism.

Figure 10:
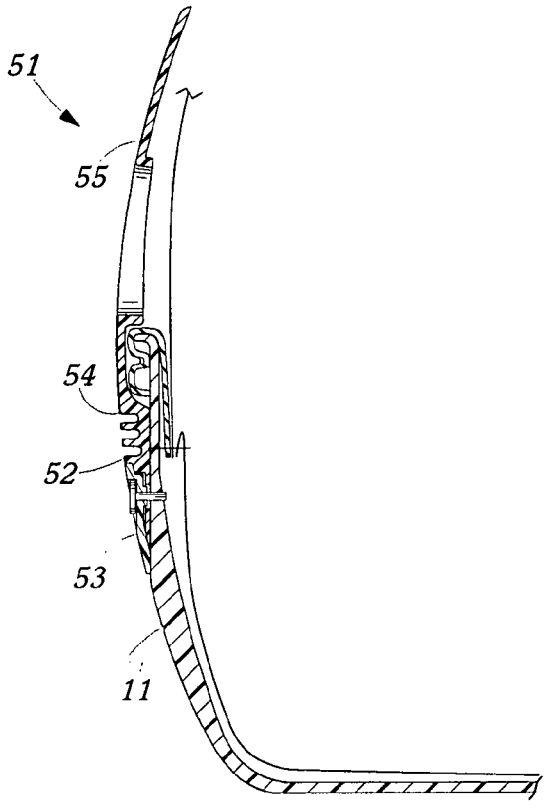
FIG. 10 is a section view taken along line 10—10 of FIG. 2 illustrating the connection means of one embodiment of the strap anchor 51.

As illustrated in FIG. 10, the strap anchors 51 are generally riveted or screwed to the side of the hard side rear portion 11 of the luggage case 10 through the connection apertures.

Figure 11:
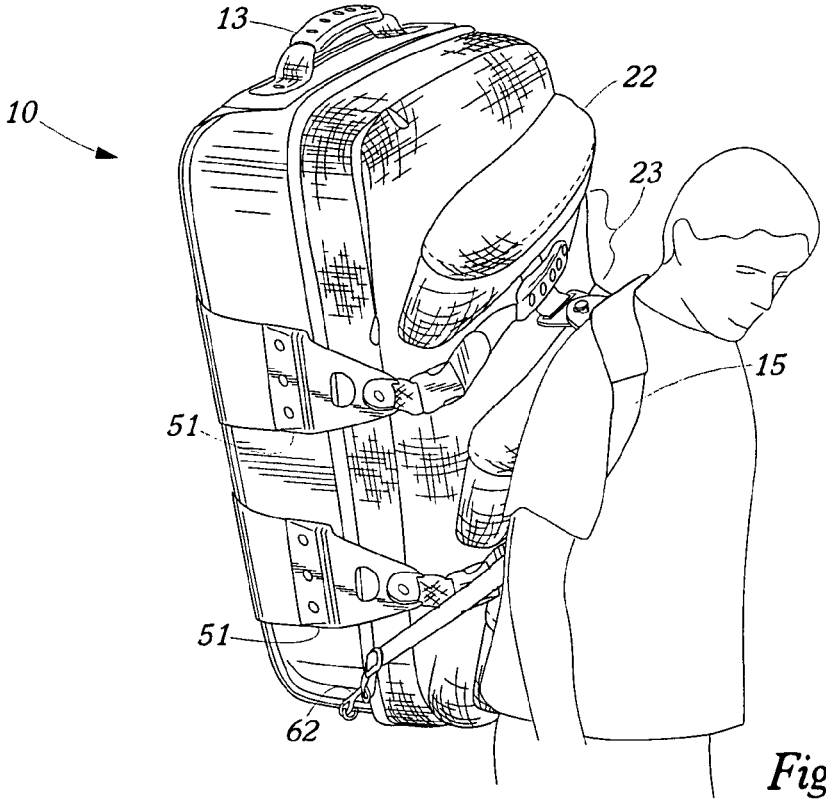
FIG. 11 illustrates a user carrying one embodiment of the luggage case in the backpack configuration.

An optional backpack carry strap 15 is available to enable the user to carry the luggage case 10 as a backpack. In the backpack configuration as illustrated in FIG. 11, the user can carry the luggage case 10 by slipping the respective side of the carry strap 15 over the left and right shoulders, as appropriate, of the user. FIGS. 11–14 illustrate the use of the luggage case 10 in the backpack configuration.

Figure 13A:
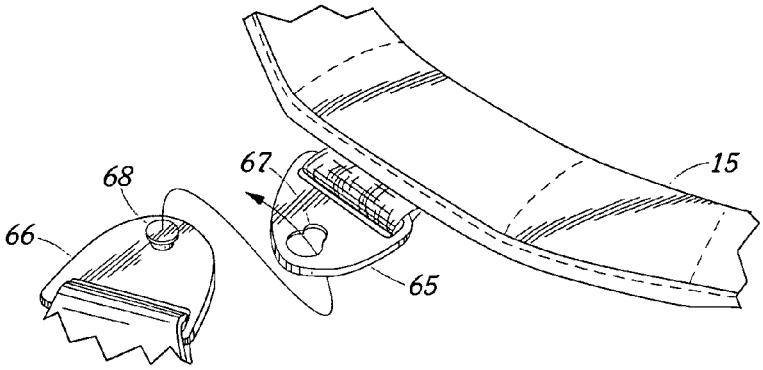
FIG. 13A is a close-up exploded view of the female clasp connected to the carry strap and the male clasp connected to the front portion 12 of one embodiment of the luggage case prior to connecting.

The carry strap 15 is an elongated webbing material 61 with clasps 62 attached at each end to engage D-loops 63 located on the bottom corners of the rear portion 11. Centrally located along the strap is a cushion pad 64 that helps comfort the user when using the strap. The cushion pad 64 has a curved yoke shape, with a central portion and two extending arms. The yoke portion is generally formed from an extendable or elastic material such as neoprene. The webbing 61 can be attached to the ends of the arms, or could extend continuously through the cushion. The central portion is generally wider than the extending arms. As shown in FIG. 13A, a female clasp 65 is centrally connected to the carry strap 15 and directly on the central portion of the cushion. When used in the back pack configuration, the female clasp 65 connects the carry strap 15 to the male clasp 66 affixed to the front portion 12 of the luggage case 10 (see FIG. 3), preferably in the channel formed between the top and middle pockets. It can be near the carry handle 38. The ends of the strap are attached to the D-loops 63 mounted at, near, or adjacent to the bottom corners of the rear portion 11.

FIG. 13A illustrates the female clasp 65 and male clasp 66 in an unconnected position. In FIG. 13A, a keyhole shaped aperture 67 is clearly shown, and is formed by generally connecting circles, one of which has a smaller radius. A large open area is formed that opens on a smaller open area. A plate having a cylindrical protrusion 68 extending therefrom forms the male clasp. A larger diameter, generally disk-shaped cap is centered on end of the protrusion. The cap is small enough to fit through the larger opening in the female clasp 65, but is larger than the smaller opening in the female clasp. When the female clasp and male clasp are connected to form a conversion clasp, the cylindrical protrusion portion of the male clasp is received in the smaller portion of the keyhole-like aperture in the female clasp.

Preferably, the cylindrical protrusion fits in the smaller opening with a snap-fit so the clasps do not disengage from one another.

Figure 13B:
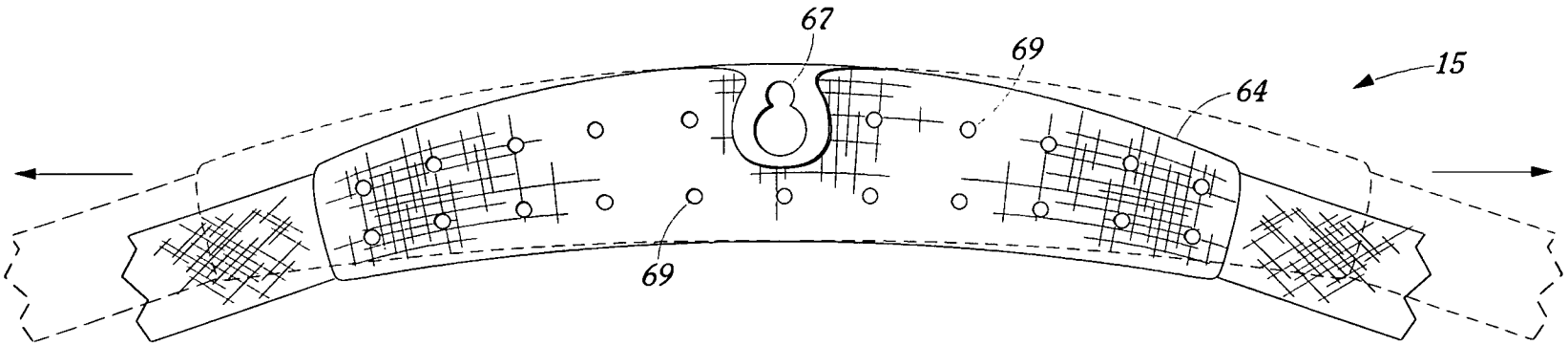
FIG. 13B is atop view of one embodiment of the carry strap.

FIG. 13B illustrates an alternative embodiment of the carry strap 15. In FIG. 13B, the carry strap 15 includes a centrally located, extendable, elastic-like yoke portion. As shown in FIG. 13B, when in an unstretched position, the yoke portion of the carry strap 15 is slightly curved. At the apex of the curved yoke portion is a female clasp insert. The clasp insert is integral to the yoke portion. In other embodiments, the clasp insert could be a male clasp or any other similarly functioning connection means. In the embodiment illustrated in FIG. 13B, the female clasp insert is similar to the female clasp described above. It includes a clasp aperture 67 that is keyhole-like in shape with a larger circular aperture joined to a smaller circular aperture.

The yoke portion is preferably constructed of materials that are extendable, expandable, and/or elastic-like. In the embodiment in FIG. 13B, the yoke portion is constructed of neoprene. In addition, in a preferred embodiment, the yoke portion is perforated. Perforating the yoke portion can increase the flexibility and extendability of the carry strap 15. In addition, perforations 69 increase the number of edges that contact the user thereby increasing the overall grip of the carry strap 15 when used either as a shoulder strap or a backpack strap. Also, perforating the yoke portion of the carry strap 15 increases the airflow between the strap and the user thereby helping to cool the contact areas between the yoke portion and the user.

The elastic-like yoke portion of the carry strap 15 embodiment illustrated in FIG. 13B stretches from an unstretched first position (solid lines) to a stretched second position (dashed lines) when suspending a loaded luggage case 10, whether used as a shoulder strap or a backpack strap. The elastic-like yoke portion returns to the unstretched first position when not suspending a load. The elastic quality of the yoke material serves as a shock-absorbing device by absorbing forces generated from the backpack load thereby supporting the backpack load while maintaining the comfort of the user.

Preferably, whether being used in an over-the-shoulder mode or in a backpack mode, the primary portion of the carry strap 15 to contact the user is the elastic-like yoke portion. By utilizing the strap in this manner, the user will receive the most benefit from the comfort features described above. Therefore, in a preferred embodiment the overall length and adjustability of the carry strap 15 and the length of the yoke portion are sized to ensure that when in use primarily the yoke portion of the carry strap 15 contacts the user, regardless of the user's size.

In other embodiments of the carry strap 15, the yoke portion can be constructed of a combination of materials exhibiting a combination of characteristics. Some materials may be stretchy or elastic-like and some may not. Factors to be considered in selection of materials include but are not limited to the cost of materials, the types and weights of loads supported by the carry strap 15, and the compatibility and ease of connecting adjoining materials. For example, in one embodiment, the yoke portion of the carry strap 15 may only include elastic-like materials on the portions of the yoke that extend over a user's shoulder. The portion of the yoke that remains behind a user's neck may be constructed of a non-elastic material.

Figure 12:
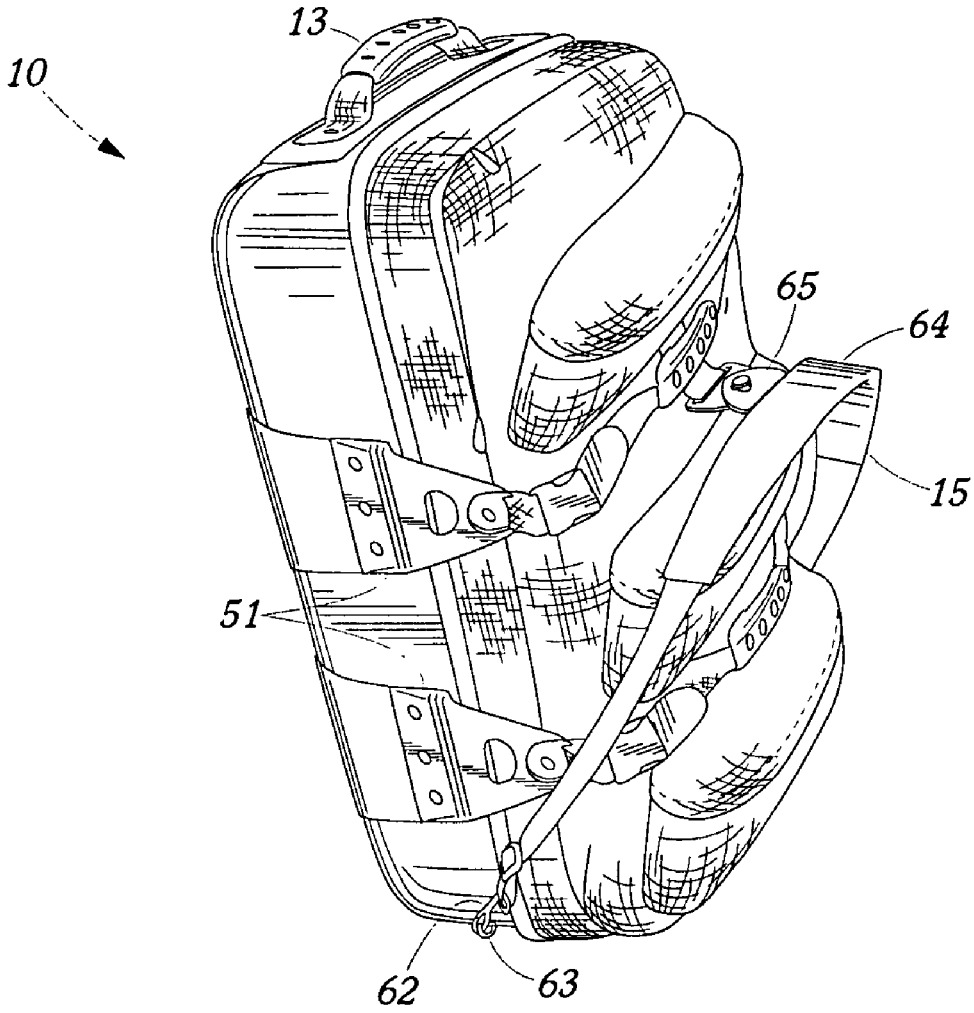
FIG. 12 is a front isometric view of one embodiment of the luggage case with the backpack carry strap attached.
Figure 14:
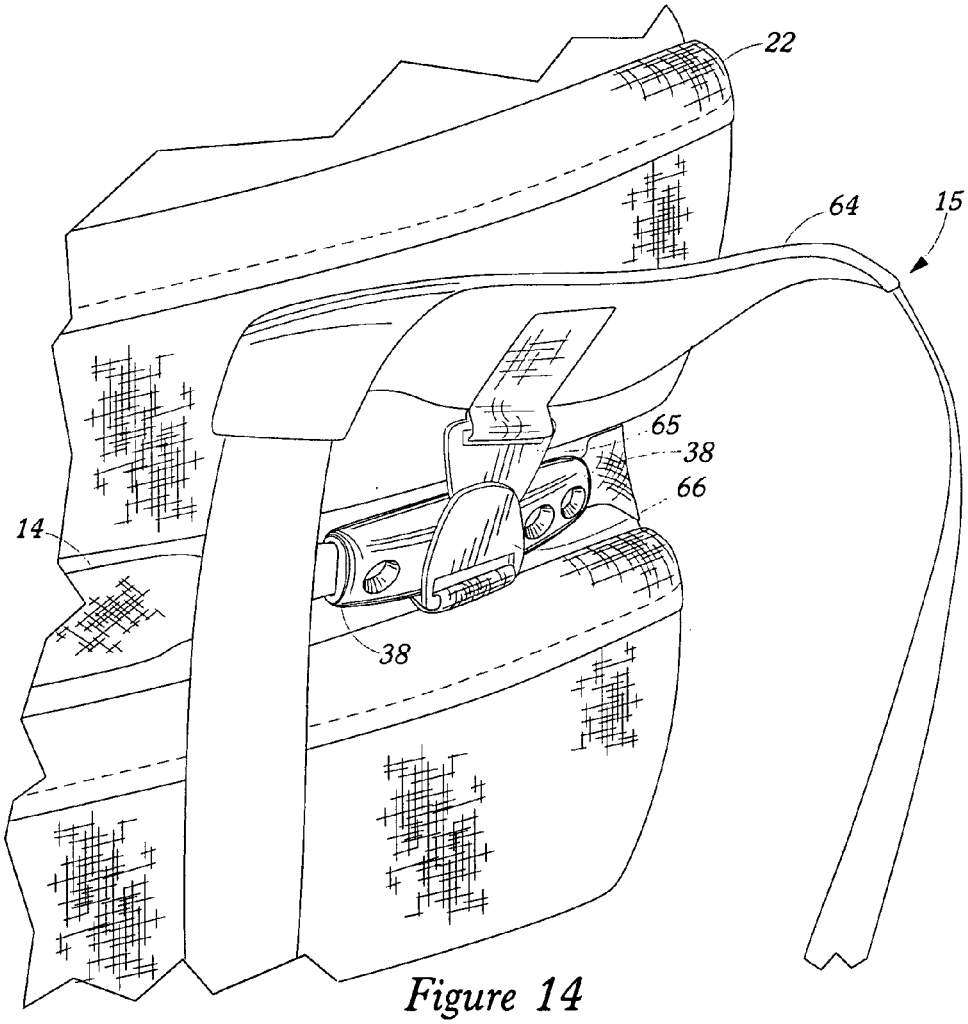
FIG. 14 is a close-up view of one embodiment of the carry strap and conversion clasp in the backpack configuration.

FIG. 14 provides a close-up view of the carry strap 15 and conversion clasp illustrated in FIG. 12. In the preferred embodiment shown in FIGS. 12 and 14, the male clasp is attached to the top front portion 12 of the luggage case 10 in the space 23 between protruding pockets 22, and the female clasp is fixed to the carry strap 15. In alternative embodiments, the female clasp could be attached to the luggage case 10 and the male clasp could be attached to the carry strap 15. In addition, in still further embodiments, other attachment means including snaps, buttons, loops, and related attachment means could be used to attach the convertible carry strap 15 from a shoulder to a backpack strap.

While the invention has been particularly shown and described with reference to a preferred embodiment thereof, it will be understood by those skilled in the art that various other changes in the form and details may be made without departing from the spirit and scope of the invention.

The invention claimed is:

1. A luggage case 10 comprising:

a. a molded, relatively hard-sided rear portion 11;

b. a soft-sided front portion 12 attached to said rear portion 11;

c. an upper attachment mechanism affixed to said front portion 12;

d. a pair of lower attachment mechanisms affixed to said rear portion 11; and e. a strap having opposing ends and an intermediate yoke portion, said yoke portion attached to said upper attachment mechanism and said opposing ends each attached to one of said lower attachment mechanisms to allow the case to be carried on one's back.

2. The luggage case 10 as defined in claim 1, wherein:

a. said yoke portion is elastically extendable.

3. The luggage case 10 as defined in claim 1, wherein:

a. integral to said yoke portion is a connecting means for connecting said strap to said upper attachment mechanism.

4. The luggage case 10 as defined in claim 1, wherein:

a. said yoke portion is constructed of neoprene.

* * * * *